United States Patent [19]

Brocklebank et al.

[11] Patent Number: 4,494,906

[45] Date of Patent: Jan. 22, 1985

[54] EARTHMOVING MACHINE

[75] Inventors: Norman Brocklebank, Beverley; Kenneth A. Deighton, Cottingham, both of England

[73] Assignee: Priestman Brothers Limited, Hull, England

[21] Appl. No.: 435,466

[22] Filed: Oct. 20, 1982

[30] Foreign Application Priority Data

Oct. 21, 1981 [GB] United Kingdom ..... 8131708

[51] Int. Cl.[3] ..... B66C 23/72

[52] U.S. Cl. ..... 414/719; 212/197

[58] Field of Search ..... 414/719, 694; 212/195, 212/196, 197, 198; 172/611

[56] References Cited

U.S. PATENT DOCUMENTS

| | | | |
|---|---|---|---|
| 2,022,808 | 12/1935 | Kerr | 414/694 |
| 2,639,826 | 5/1953 | Welden | 414/732 |
| 3,279,632 | 10/1966 | Kramlich | 414/694 |
| 3,938,669 | 2/1976 | Vinton | 414/719 X |
| 3,963,133 | 6/1976 | Gilli | 414/719 |
| 4,085,854 | 4/1978 | Baron | 414/719 X |
| 4,113,112 | 9/1978 | Ray | 212/198 X |

FOREIGN PATENT DOCUMENTS

| | | |
|---|---|---|
| 33060 | 10/1980 | European Pat. Off. . |
| 1110475 | 4/1968 | United Kingdom . |

*Primary Examiner*—Joseph E. Valenza
*Assistant Examiner*—Donald W. Underwood
*Attorney, Agent, or Firm*—Finnegan, Henderson, Farabow, Garrett & Dunner

[57] ABSTRACT

An earthmoving machine primarily for land drainage and irrigation purposes has a pivotally mounted boom (8) carrying an arm (12) pivoted at one end to one end of the boom and having a bucket (14) or the like attached at its other end. At the end of the arm which is pivoted on the boom a quadrant (20) is formed around which passes a pendant cable (18) attached to a counterweight (22) which is slidable on the rearwardly extending end of the boom, the counterweight, and thus the arm, being moved by a ram (24) so that radially outwards movement of the arm (12) is accompanied by outwards movement of the counterweight (22) along the end of the boom in the opposite direction to balance the machine. A draw-in rope or cable (26) is attached to the free end of the arm in order to draw-in the arm towards the pivot axis of the boom, the ram (24) and draw-in rope winch (25) being hydraulically connected so that the one is operative when the other is in neutral and vice versa.

10 Claims, 3 Drawing Figures

EARTHMOVING MACHINE

Figure 1:
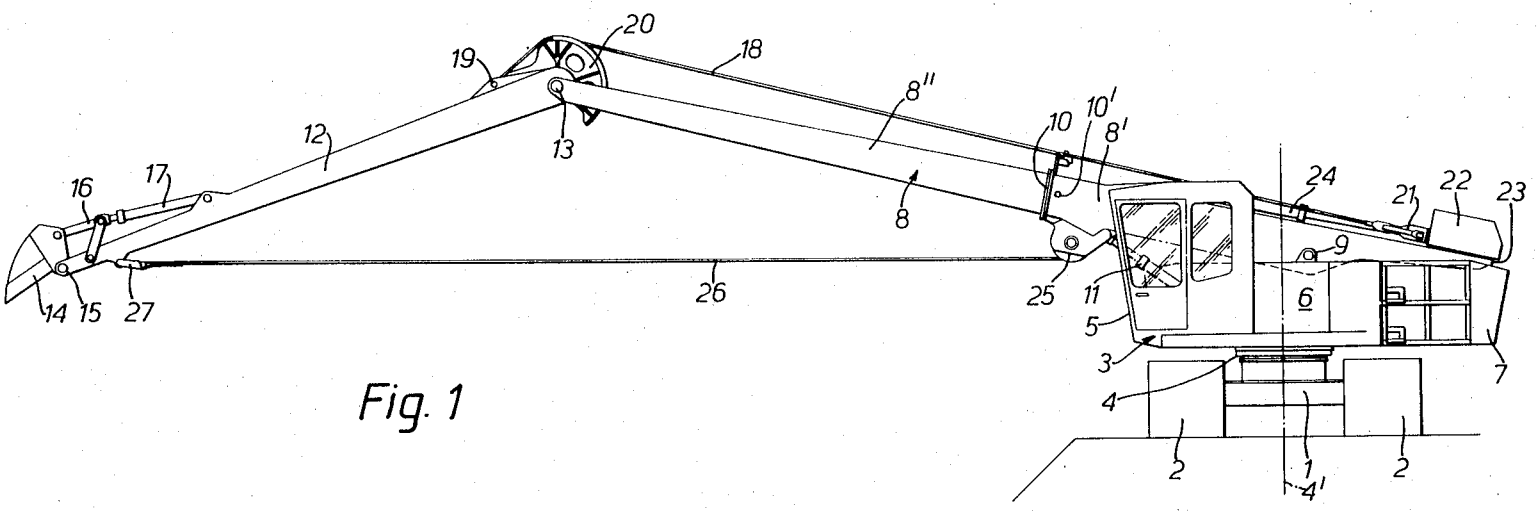

The present invention relates to earthmoving machines and in particular to machines intended primarily for land drainage and irrigation purposes, but also to more standard excavator applications.

Conventionally, draglines have been used for dredging and/or reshaping of drainage channels, such draglines being available in a wide range of sizes to suit particular jobs. However, the great disadvantage of using a dragline is that it demands a great deal of operator skill due to its flexible action which necessitates a high level of control to achieve accurate working. Furthermore, a dragline is ineffective on the far slope of a drainage ditch or water-course and the bucket needs to be long and relatively narrow with teeth, which is not conducive to neat trimming of the slopes or so-called "batters".

More recently, conventional hydraulic backhoes with extended booms and arms and wide shallow buckets have been used at the lower end of the size range, in place of draglines, the weight of the extended boom and arm being counter-balanced by the conventional fixed counterweight on the tail of the bed plate of the machine. Although the longreach backhoe overcomes some of the operational problems of draglines and to a large extent reduces the skill required for operation as the equipment is rigid, the angle of the bucket being variable at will and ram power being available for penetration, the equipment is so heavy that the actual permissible payload is usually very small and the machine requires a heavy counterweight which tends to make it tail heavy. Furthermore, a low unit ground pressure can only be achieved by fitting long wide tracks and even with these fitted the machine is inclined to rock and to sink itself into soft ground.

It is known, see for example DE-A-3126324, to provide a travelling crane with a counterweight which can be moved, under the influence of a hydraulic ram, to different positions to provide counterbalancing of the crane for different operating jib lengths. Furthermore, it is known from, for example, EP-A-0033060, to provide a pivoting counterweight on an excavating machine with a grab.

According to the present invention therefore an earth moving machine having a boom pivotally mounted intermediate its ends about a generally horizontal axis, an arm pivotally mounted at one end of the boom, and a movable counterweight at the other end of the boom, is characterized in that the counterweight moves radially outwardly along the boom relative to the pivot axis of the boom simultaneously with radial outward pivoting of the arm relative to the pivot axis of the boom in order to maintain the desired degree of balance of the machine.

More particularly, the present invention provides an earth moving machine comprising a base; a generally horizontal axis defined on the base; a boom having a first end and a second end and being pivotally mounted intermediate its ends about the horizontal axis; pivot means at the first end of the boom; an arm mounted on the pivot means at the first end of the boom; a movable counterweight at the second end of the boom; means for moving the counterweight; means operatively connecting the arm to the counterweight arm and adapted to cause the arm to pivot outwardly away from the axis as the counterweight is moved outwardly in the opposite direction and to cause the counterweight to move inwardly as the arm pivots toward the axis; a winch, the winch being mounted on the machine remote from the pivot means; and a cable extending from the winch to the end of the arm remote from the boom, whereby operation of the winch to wind in the cable draws the arm inwards towards the axis.

Preferably the means for moving the counterweight slides the counterweight along the boom in a direction opposite to that of the arm.

Preferably the arm is moved by one or more cables attached to the counterweight and the counterweight is actuated directly by one or more hydraulic rams so that movement of the ram controls movement of the counterweight and, simultaneously, movement of the arm. In order to maintain direct cable pull on the arm to provide for constant load application the or each cable may be passed around a respective quadrant concentric with the pivot point of the arm on the boom. Preferably, the end of the arm remote from the boom is attached to a cable which extends from a winch mounted on the machine remote from the pivot point of the arm on the boom whereby the arm can be drawn inwards towards the pivot point of the boom by means of the winch.

By constraining the counterweight and arm to move in sympathy with one another the movement of the centre of gravity of the machine is limited thus providing considerable benefits in terms of machine operation stability, reduced slewing inertia and, above all, allowing higher payloads to be handled at larger working radii. Furthermore, by enabling the arm, carrying in use a conventional bucket or other equipment, to be moved towards or away from the pivot point of the boom by means of the winch and cable and pendant cables respectively, the conventional hydraulic ram operating between the arm and boom can be dispensed with allowing the arm and boom to be of a lighter construction. This is possible because the use of a hydraulic ram between the arm and boom causes high load stresses in the arm and boom adjacent its mounting points and also because the arm and boom have to be able to support considerable bending moments when the bucket or other equipment is being drawn radially inwards during digging. By operating the arm by cables as described the functions of the boom and arm are changed so as to provide merely guidance and load lifting so that they do not require to be bulky elements associated with the heavy highly stressed elements which are necessary to withstand big ram-thrusts as on a conventional backhoe.

The winch motor and counterweight ram can be controlled from the same operating lever, movement of the lever in one direction causing operation of the winch motor with the ram being placed in neutral and movement of the lever in the opposite direction causing extension of the ram with the winch motor being placed in neutral. By such hydraulic interconnection between the operating motor of the winch and the ram operation of the two together can be avoided thus preventing mutually exclusive movements of the machine being attempted together and preventing any damage.

Alternatively, if ram power is required on the arm between the boom and arm then the ram controlling operation of the arm relative to the boom and the hydraulic ram controlling operation of the counterweight can be connected to extend and retract respectively simultaneously to maintain the balance of the machine.

Figure 2:
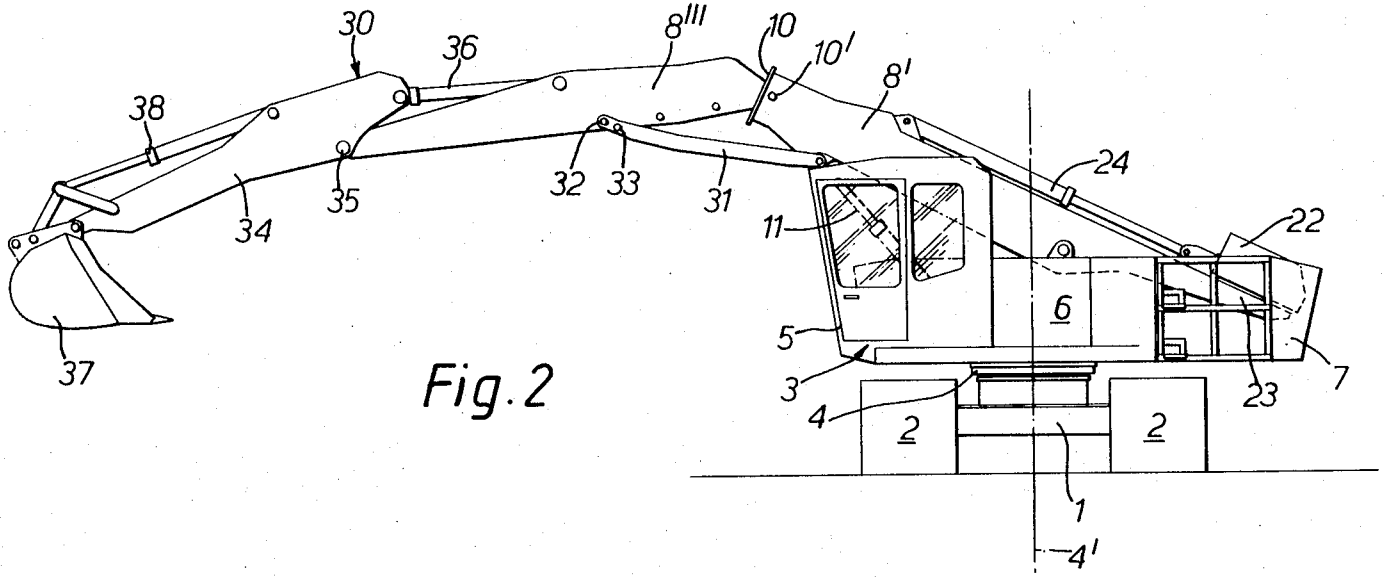

One example of a machine constructed in accordance with the present invention will now be described with reference to the accompanying drawings in which:

FIG. 1 is a side elevational view of the machine; FIG. 2 is a second side elevational view of the machine with a modified boom and arm configuration; and, FIG. 3 is a block diagram of part of the hydraulic control system of the machine.

Figure 3:
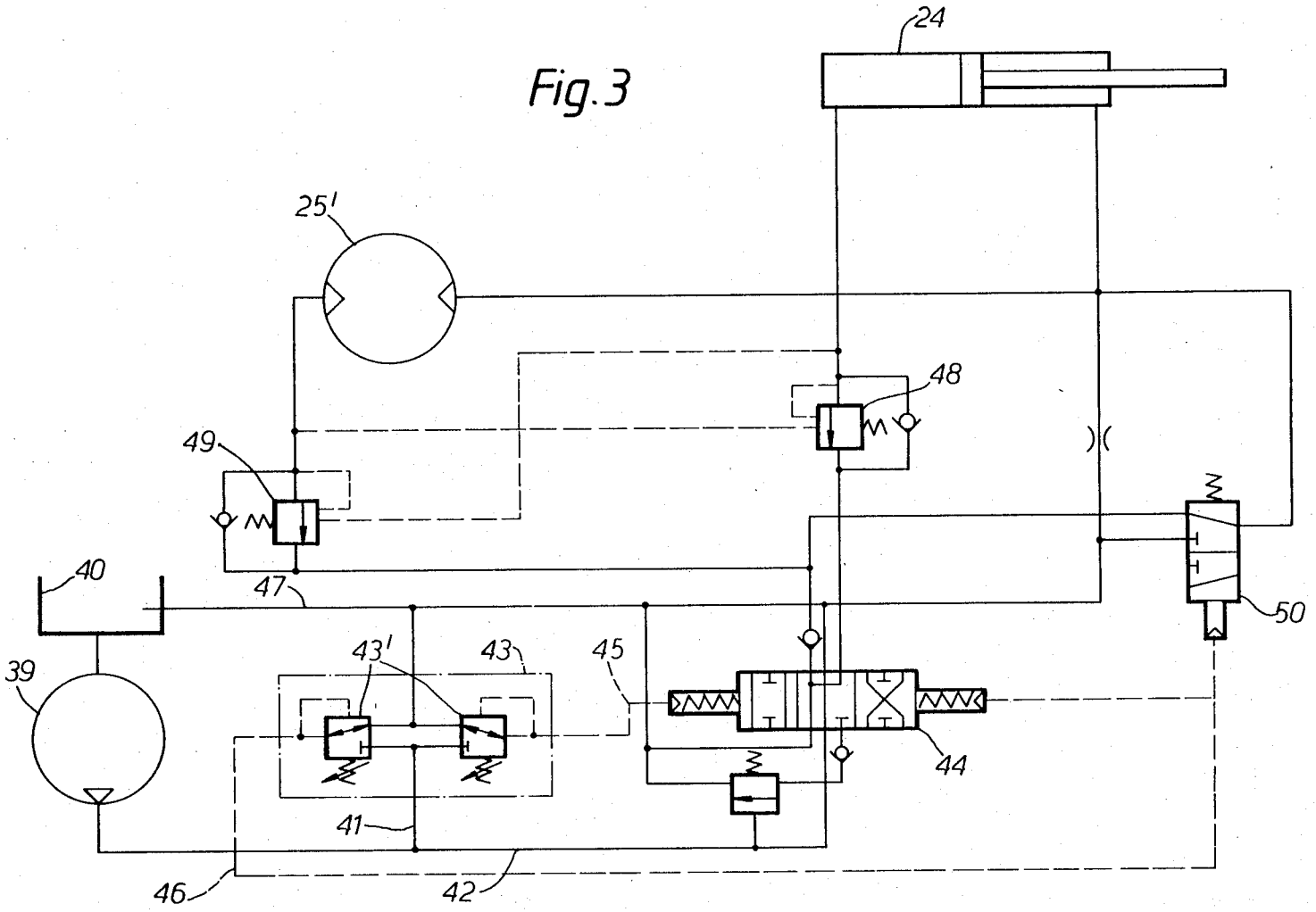

The machine shown in FIG. 1 comprises a chassis or base 1 which mounts a pair of endless tracks 2 which are arranged to be driven, when required, by a hydraulic motor (not shown) supplied by a hydrostatic pump (39, FIG. 3). On the chassis 1 a superstructure 3 is mounted by means of a slewing ring 4, thus enabling the superstructure to be turned to any desired position. The axis of the slewing ring is shown as 4'. The superstructure 3 includes a conventional cab 5 for the operator, together with a machinery housing 6 and safety fender 7. The superstructure mounts a boom 8 pivotally mounted intermediate it ends on a substantially horizontal pivot axis 9, the boom 8 being arranged in two halves 8', 8'', the two halves being connected together at a flanged joint 10, pivot 10' or alternative type of connection. To raise or lower the boom a conventional hydraulic ram 11 is employed.

At the end of the boom remote from the superstructure an arm 12 is pivotally mounted, about an axis 13, the arm in turn carrying a bucket 14. The bucket 14 is pivoted about an axis 15 and a conventional linkage 16, which can be powered by a further hydraulic ram 17, is used to control the position of the bucket on the end of the arm. As is conventional, the fitting at the end of the arm is adapted to receive buckets of different sizes to suit particular conditions.

To control the angle of the arm relative to the boom a pair of pendant cables 18 (one shown) are attached to the arm at a point 19. The cables 18 pass over a quadrant 20 which is formed or mounted at the end of the arm 12 so as to be concentric with the pivot point 13 of the arm 12 on the boom 8. The pendant cables 18 extend to adjustable fittings 21 mounted on the forward end of a counterweight 22 which is slidable by means of rollers (not shown) on a trailing portion 23 of the boom 8. The position of the counterweight is controllable in turn by means of a further hydraulic ram 24.

A hydraulically powered winch drum 25 is mounted in an underslung position below the boom 8 and a draw-in cable 26 wound on the winch drum 25 extends from the winch drum to a mounting 27 on the arm adjacent the mounting point of the bucket.

In use the bucket 14 is positioned by extension or retraction of the boom ram 11 (to vary the angle of the boom) and by extension of the ram 24 which, through the counterweight 22, the fittings 21 and the pendant cables 18, adjusts, in the outward direction, the angular position of the arm relative to the boom. The angle of the bucket relative to the end of the arm can be controlled by extension or retraction of the hydraulic ram 17. Once the bucket has penetrated the earth or scooped up the material to be collected the winch drum 25 is operated to draw in the rope 26 thus pulling in the bucket towards the superstructure for subsequent disposal of the spoil at a suitable position.

It will be appreciated that the sliding counterweight 22 moves in sympathy with the arm and bucket at all times so that as the bucket moves out to the digging position so the counterweight slides to the rear to maintain the balance against the forward load, and vice versa. This has the effect of limiting the movement of the centre of gravity of the machine with benefits in terms of stability, reduced slewing inertia and, above all, allowing significant payloads to be handled at full outreach of the machine. Furthermore, balancing the weight of the arm and load by means of the counterweight reduces the effort required to operate the machine and enabling an engine of lesser horsepower than would otherwise be required to be fitted to the machine. In addition, the direct pull imparted by the draw-in cable 26 provides a most powerful and efficient form of energy for drawing-in the bucket and eliminates the need to design for the massive forces exerted at the arm head by conventional ram power which, when transmitted through the arm to the bucket to aid penetration, demand a suitably heavy structure. The use of draw-in cable results in bigger bucket capacity and more output. The quadrant 20 is provided so as to maintain the pendant cables 18 at a constant radial distance from the arm pivot point 13 throughout the operating cycle to provide a constant moment arm. Thus, unlike a hydraulic ram, a constant load application can be provided which contributes to arm efficiency in handling larger buckets at maximum radius.

It will be appreciated that the position of the winch may be varied from that shown, and may for example be mounted directly on the superstructure. By arranging for an effective interlock between the controls for the counterweight ram 24 and winch drum 25 it is possible to avoid accidental actuation of the winch when the ram 24 is being extended. Obviously, were such to occur then serious structural damage could occur before the draw-in cable 26 breaks. This is most simply achieved (as will be described in further detail), by arranging for the operating lever which controls actuation of the ram 24 also to control operation of the winch drum 25, the lever being arranged so that in, for example, a forward position, the ram 24 is extended and thus the arm 12 swung outwards whilst the winch motor is in neutral, opposite movement of the lever causing the ram 24 to be put into neutral and the winch drum 25 rotated to draw-in the cable 26.

As mentioned above, the boom 8 is split at a flanged joint 10. This joint 10 and a pivot point 10' enable a conventional back-hoe assembly 30 to be fitted to the machine as shown in FIG. 2.

FIG. 2 shows the lower half of the boom 8' fixed, by means of the pivot 10', to a boom part 8''' forming the boom of a conventional backhoe assembly 30. In practice, the machine shown in FIG. 1 can be modified in the form shown in FIG. 2 in a short space of time, simply by removing the arm 12, boom part 8'' and cables 18 and fitting the back hoe assembly 30. The boom part 8''' is additionally fixed in position by means of a pair of stays 31 fixed at one end to the boom 8' (as shown, to the mounting point of the ram 11) and at the other end to the arm 8''' at one of two bolt positions 32, 33. The boom part 8'''mounts an arm 34 on a pivot 35, the position of the arm 34 relative to the boom being controlled by means of a conventional hydraulic ram 36 and the bucket 37 mounted on the end of the arm 34 likewise being controlled by a similar ram 38. To achieve dynamic balancing of the modified machine in use the control lines which in the unmodified machine feed the winch motor are connected instead to the ram 36 in such a way that retraction of the ram 36 causes simultaneous extension of the ram 24 and vice versa, thereby causing the counterweight 22 and arm 34 to move in sympathy with one another to maintain the required balance.

FIG. 3 shows part of the hydraulic control system of the machine, and in particular that part of the control system relating to the control of the counterweight ram 24 and the draw-in cable winch drum 25. The diagram is schematic and is simplified in order to ease understanding.

A hydrostatic pump 39 draws hydraulic fluid from a sump 40 and passes it through feed lines 41 and 42 to a control lever valve 43 and a pilot operated control valve 44. The control lever valve 43 is shown diagrammatically to include a pair of valves 43' which are interconnected so that when one valve supplies fluid from the pump 39 to the pilot operated control valve 44 through one of the two supply lines 45, 46, the other valve 43' allows reverse flow through exhaust line 47 to the sump 40.

The pilot operated control valve 44 is shiftable between three positions, a central, neutral position, a left hand position (right hand side of the control valve spool as diagrammatically shown) in which hydraulic fluid is directed to the draw-in winch drum motor 25' for operation to draw-in the cable 26, the counterweight ram 24 being allowed to drain, and a right hand position (left hand side of the control valve spool as diagrammatically shown) in which hydraulic fluid is directed to the ram 24 to extend it, the winch drum motor 25' being allowed to unwind in neutral. In the neutral position of control valve 44, hydraulic fluid flows straight through the control valve and back to the sump 40.

Fluid from the pilot operated control valve 44 to the ram 24 and motor 25' is fed respectively through valve systems 48 and 49 interconnected to enable one or the ram 24 and motor 25' to be allowed to drain when the other is being fed from the control valve 44. The valve systems 48 and 49 each include a pressure relief valve so that if anything causes the ram 24 or which motor 25' to be overloaded with the spool in neutral, the relief valve blows and excess fluid is discharged to the sump.

The valve 50 prevents cavitation (or oil starvation) when the winch motor 25' is unwinding.

We claim:

1. An earth moving machine comprising a base; a generally horizontal axis defined on said base; a boom having a first end and a second end, said boom being pivotally mounted intermediate its ends about said generally horizontal axis; pivot means at said first end of said boom; an arm mounted on said pivot means at said first end of said boom; a movable counterweight at said second end of said boom; means for slidably moving said counterweight along said boom; means operatively connecting said counterweight to said arm and adapted to cause said arm to pivot outwardly away from the axis as the counterweight is moved outwardly along the boom in the opposite direction and to cause the counterweight to move inwardly along the boom as the arm pivots toward the axis; a winch, said winch being mounted on said machine remote from said pivot means; and a cable extending from said winch to the end of said arm remote from said boom, whereby operation of said winch to wind in said cable draws said arm inwards towards said axis.

2. A machine according to claim 1, wherein said means operatively connecting said counterweight to said arm comprises at least one pendant cable connecting said counter weight to said arm.

3. A machine according to claim 2, further comprising a quadrant concentric with said pivot means, said pendant cable passing around said quadrant.

4. A machine according to claim 2, wherein the means for moving the counterweight includes a hydraulic ram, said ram being attached to said counterweight to move said counterweight outwardly away from said axis and arm, whereby movement of said ram to move said counterweight outwardly simultaneously moves said arm, via said at least one pendant cable, in the opposite direction.

5. A machine according to claim 4, further comprising a quadrant concentric with said pivot means, said pendant cable passing around said quadrant.

6. A machine according to claim 4 including means for hydraulically interconnecting said winch and said hydraulic ram to prevent operation of the one when the other is operated.

7. A machine according to claim 6 wherein the means for interconnecting the winch and the ram includes a common lever valve adapted to operate said winch and said hydraulic ram, said lever valve being arranged such that movement of said lever in said one direction causes operation of said ram to extend said arm and movement of said lever in the opposite direction causes operation of said winch to draw in said cable and thus the free end of said arm.

8. An earth moving machine comprising a base; a generally horizontal axis defined on said base; a boom having a first end and a second end, said boom being pivotally mounted intermediate its ends about said generally horizontal axis; pivot means at said first end of said boom; an arm mounted on said pivot means at said first end of said boom; a moveable counterweight at said second end of said boom; means for moving said counterweight; a pendant cable operatively connecting said arm to said counterweight to cause said arm to pivot outwardly away from the axis as the counterweight is moved outwardly in the opposite direction and to cause the counterweight to move inwardly as the arm pivots toward the axis; a winch, said winch being mounted on said machine remote from said pivot means; and a cable extending from said winch to the end of said arm remote from said boom, whereby operation of said winch to wind in said cable draws said arm inwards towards said axis.

9. A machine according to claim 8, wherein the means for moving the counterweight includes a hydraulic ram, said ram being attached to said counterweight to move said counterweight.

10. A machine according to claim 9, including means for hydraulically interconnecting said winch and said counterweight ram to prevent operation of the one when the other is operated.

* * * * *